US005269044A

United States Patent [19]

Marion

[11] Patent Number: 5,269,044

[45] Date of Patent: Dec. 14, 1993

[54] HANDLE FOR ASSISTING IN BOARDING OR DISEMBARKING A WATER VESSEL

[76] Inventor: Maurice Marion, 1 Coronation Blvd., Apt. No. 804, Lively, Ontario, P0M 2E0, Canada

[21] Appl. No.: 840,282

[22] Filed: Feb. 24, 1992

[30] Foreign Application Priority Data

Feb. 25, 1991 [CA] Canada ..... 2036956

[51] Int. Cl.[5] ..... B63D 17/00

[52] U.S. Cl. ..... 16/112; 114/362; 16/126; 16/115

[58] Field of Search ..... 114/362, 364, 218; 16/110 R, 111 R, 112, 115, 126

[56] References Cited

U.S. PATENT DOCUMENTS

| | | | |
|---|---|---|---|
| 1,227,929 | 5/1917 | Ralston | 16/112 |
| 1,956,593 | 5/1934 | Riddick | 16/112 |
| 3,892,290 | 7/1975 | Lang | 182/22 |
| 3,980,157 | 9/1976 | Wrigley | 182/163 |
| 4,161,795 | 7/1979 | Quest | 9/1.6 |
| 4,541,507 | 9/1985 | Gibellato | 182/86 |
| 4,561,526 | 12/1985 | Winter et al. | 16/112 |
| 4,719,989 | 1/1988 | Ritten | 182/93 |
| 4,751,982 | 6/1988 | Wolfe | 182/164 |
| 4,926,965 | 5/1990 | Fox | 114/362 X |
| 4,964,355 | 10/1990 | Milewski | 114/218 |
| 5,005,255 | 4/1991 | Pare et al. | 16/112 X |
| 5,014,640 | 5/1991 | Owen, Sr. | 114/362 |

FOREIGN PATENT DOCUMENTS

| | | | |
|---|---|---|---|
| 965756 | 4/1975 | Canada | 228/8 |
| 44092 | 5/1931 | Denmark | 114/218 |
| 2235040 | 1/1975 | France . | |
| 2391107 | 12/1978 | France . | |
| 2429144 | 2/1980 | France | 114/362 |
| 2438578 | 5/1980 | France . | |
| WO88/01843 | 3/1988 | PCT Int'l Appl. . | |

*Primary Examiner*—Sherman D. Basinger
*Attorney, Agent, or Firm*—Weldon F. Green

[57] ABSTRACT

An improved handle for assisting in boarding or disembarking a water vessel such as a boat or power boat, particularly when such vessel is docked. The handle is pivotally secured to the dock so as to preferably swing from a position substantially vertical to the dock to a position substantially horizontal thereto, and reversely. Further, the handle, in one embodiment, is releasably secured to the dock at the pivot point so that it can be removed for storage when not in use. In another embodiment the handle includes a shaft comprised of a plurality of sections which slide with respect to one another and which are releasably secured to one another so that the hand-gripping portion can be removed for storage when not in use. Yet another embodiment of the invention features a handle which is releasably locked in the substantially vertical position to provide support for a user boarding or disembarking the water vessel.

18 Claims, 4 Drawing Sheets

HANDLE FOR ASSISTING IN BOARDING OR DISEMBARKING A WATER VESSEL

FIELD OF THE INVENTION

This invention relates to improvements in a handle for assisting in boarding or disembarking a water vessel such as a boat or power boat, particularly when such vessel is docked.

This invention particularly relates to improvements in a handle for assisting in boarding or disembarking a water vessel wherein the handle is pivotally secured to a suitable support surface, such as a dock, so as to swing preferably from a position substantially vertical to the support surface to a position substantially horizontal thereto, and reversely. More particularly, the handle of this invention in various embodiments is releasably secured to the support surface so as to be removable therefrom for storage when not in use. In one embodiment the handle is releasably secured to the support surface at the pivot point. In another embodiment the handle of this invention features slidable inner and outer extendable shaft portions which are releasably secured to one another.

Further embodiments disclose mechanisms for releasably locking the handle in the substantially vertical position to the support surface.

BACKGROUND OF THE INVENTION

It can be appreciated by the average boating enthusiast that boarding or disembarking a docked water vessel, particularly a power boat, without assistance from another person nearby can often be quite hazardous and difficult—especially where one utilizes a power boat of the type having a gunwale onto which a person steps during boarding or disembarking.

Further, the boarding or disembarking maneuver from a power boat can be aggravated by waves in rough or choppy water which can cause the boat to bob vigorously in the water.

Prior handles for assisting in boarding or disembarking a water vessel, such as a power boat, normally comprise a handle which is mounted on the gunwale of the vessel. See, for example, the handle described in Canadian Patent No. 1059840. Such handles are of complex construction in order that the handle can be lowered out-of-sight beneath the gunwale of the power boat when not in use. To achieve this, the handle comprises inner and outer substantially rigid telescoped tubes which, when unrestrained, are freely axially slidable relative to one another.

Complex construction of such a handle allows for mechanical failure. Mechanical failure poses a danger when boarding or disembarking a boat: if the mechanism restraining the slidable movement of the telescoping inner and outer tubes fails, the handle could collapse causing undue injury.

This invention overcomes the disadvantages of the prior art without requiring, as in the case of handles attached to the gunwales of power boats, extensive modification to existing boats presently on the marketplace, as will hereinafter become clear.

OBJECTS OF THE INVENTION

It is the object of this invention to provide an improved handle for assisting in boarding and disembarking of a water vessel such as a power boat, particularly when such vessel is docked.

It is a further object of this invention to provide a reliable aid for persons boarding or disembarking a water vessel, such as a power boat, in the form of a handle that is pivotally secured to a suitable support surface, such as a dock.

Further, it is an object of this invention to provide a handle for assisting in boarding or disembarking a water vessel, such as a power boat, wherein the handle is pivotally mounted to the support surface to preferably swing from a substantially vertical position, in which the handle can be comfortably grasped when boarding or disembarking the boat, to a substantially horizontal position.

It is a further object of this invention to provide a handle which is releasably secured to the support surface to allow for easy storage when not in use. Therefore, the handle is of relatively light weight construction so that it can easily be managed when moved between its storage place and the support surface.

Further, it is an object of this invention to be able to adapt existing support surfaces, such as docks, to accommodate a handle of this invention; new docks can be designed such that a handle of this invention is sunken within the upper surfaces of such docks. Such handles are out-of-sight when in the substantially horizontal position and present no obstacle on the upper surface of the dock, thereby eliminating the danger of persons tripping or otherwise injuring themselves on any hinge portions or other means for pivotally, releasably securing the handle to the dock.

It is also an object of this invention to provide a mechanism operable to releasably lock a handle of this invention in the substantially vertical position allowing the handle to provide additional support to a person boarding or disembarking a water vessel.

FEATURES OF THE INVENTION

It is a feature of this invention to provide an improved handle for assisting in boarding or disembarking a water vessel such as a power boat, particularly when such vessel is docked. The handle is pivotally secured at one end to a suitable support surface, such as a dock, and particularly is located adjacent an edge of the support surface facing the water vessel; the opposing end of the handle includes a hand-gripping formation. The improved handle of the invention swings about said pivot and preferably from a substantially vertical position to the support surface to a substantially horizontal position wherein the handle is substantially parallel to the support surface, and reversely.

Further, it is a feature of this invention to provide means for releasably securing the handle to the support surface.

More particularly, the improved handle of this invention is pivotally, releasably, secured to the support surface by a pin removably inserted through one end of the handle opposed to the hand-gripping formation, and through openings provided by upstanding flanges of a platform or base secured to the support surface.

It is a further feature of this invention, in an alternative embodiment, to provide an improved handle removable from the support surface through means of slidable inner and outer extendable shaft portions held against separation or displacement with respect to one another by a pin removably inserted through respective openings in each of the inner and outer shaft portions thereof.

Further, it is a feature of this invention to provide a handle, in an alternative embodiment of the invention, wherein the shaft of the handle is sunken in the support surface, such as the deck of a dock, so as to leave no external projection or obstacle on the upper surface of the support surface.

In particular, it is a feature of the invention to provide a handle for assisting in boarding or disembarking a water vessel wherein the handle comprises an elongate shaft portion, a hand-gripping formation located at one end of the shaft portion, and a base for pivotally receiving the opposed end of the shaft portion in securing same to a suitable support surface. The base is located near an edge of the support surface so that the hand-gripping formation and the shaft portion can swing about the pivot above the support surface to assist a person in boarding or disembarking a water vessel adjacent the edge of the support surface.

It is a further feature of the invention that the base comprises of a plate formation secured to the support surface and with the plate formation having at least one upstanding flange formation adapted to pivotally receive the opposed end of the shaft portion. In the preferred embodiment of the invention the base has two flange formations upstanding therefrom and adapted to pivotally receive the opposed end of the shaft portion.

Further, it is a feature of this invention to have the opposed end of the shaft portion releasably pivotally secured to the upstanding flange formations by a pin passing through respective aligned holes in the opposed end of the shaft portion and the upstanding flange formations.

It is also a feature of the invention to provide, in an alternative embodiment, a base in the form of a recess within the suitable support surface and opening to an edge thereof, and with the respective sides of the recess adapted to pivotally receive therein the opposed end of the shaft portion of the handle. The opposed end of the shaft portion of the handle can also be releasably pivotally secured to the respective sides of the recess by a pin passing through respective aligned holes in the opposed end of the shaft portion and respective sides of the recess.

It is also a feature of this invention, in a further alternative embodiment, to have the elongate shaft portion comprising slidable extendable inner and outer shaft portions. Further, the slidable extendable inner and outer shaft portions can be releasably secured to one another against slidable displacement by a pin passing through respective aligned holes in the inner and outer shaft portions.

More particularly, it is a feature of this invention to provide a means to releasably lock the handle at an angular orientation, and preferably vertically with respect to and above the suitable support surface.

One way that this can be accomplished is to provide suitable biasing means, such as springs extending under tension between the handle and base or support surface, in combination with an elongated slot in the handle, through which the pin which secures the handle to the base or support surface fits, and an opening or aperture in the base or support surface in alignment with the end of handle when same is disposed vertically, and of a matching configuration and having similar dimensions to the cross section of such end of the handle. As a consequence, when the handle is disposed vertically by the operator, the end of the handle adjacent the base or support surface aligns in overlying relation with the opening or aperture so provided, and the action of the bias normally urges such end of the handle within the opening or aperture.

Alternative embodiments of a handle having a locking mechanism for releasably locking the handle at an angular orientation with respect to and above the suitable support surface are also provided. In particular, an actuating member is mounted on the hand-gripping formation of the handle and operably coupled to the lock to effect the releasable locking of the handle at the appropriate angular orientation to the support surface.

The locking mechanism of this alternative embodiment of the invention comprises a locking pin fixedly secured to the base so as not to be rotatable about its longitudinal axis and provided with at least one recess opening upwardly and in an angular orientation to the support surface. The lock also comprises a locking plate operably coupled to the actuating member and biased to urge same against the surface of the locking pin, and so configured as to fit within the recess provided in the locking pin when the handle is swung about the pivot so that the locking plate overlaps the recess. Further,.it can be appreciated, that it is a feature of the invention to have the locking pin pivotally secured to the shaft portion of the handle.

It is a feature of the invention in this embodiment to have the bias of the locking mechanism as a spring located between the locking plate and a retention plate so as to urge the locking plate away from the retention plate and against the surface of the locking pin and into the recess when the handle is swung about the pivot so that the locking plate overlaps the recess.

It is a further feature of the invention to provide an actuating member operably coupled to the lock by a rod extending from the hand-gripping formation to the locking plate. Particularly, the elongate shaft portion of the handle is hollow and a rod passes through the centre of the hollow elongate shaft portion, and through respective openings in the retention plate and the spring to the locking plate.

Finally, it is a feature of the invention to have the lock be operated preferably with one hand. Accordingly, the actuating member is mounted upon the hand-gripping formation. Preferably, the hand-gripping formation is D-shaped in configuration with the actuating member located substantially within the hand-gripping formation and of a similar configuration to the hand-gripping formation but of a lesser overall extent.

DESCRIPTION OF THE INVENTION

These another objects and features will become apparent in the following description of the preferred embodiment of the invention to be read in conjunction with the accompanying sheets of drawings in which.

Figure 1:
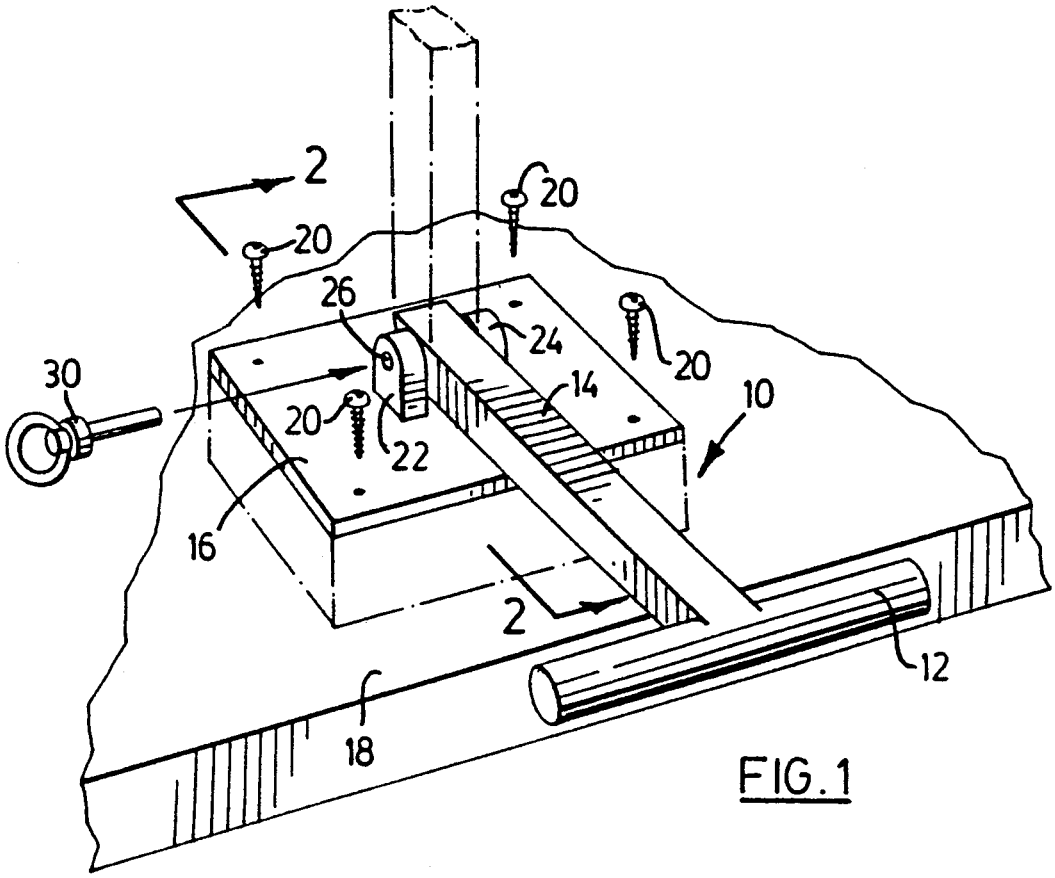
FIG. 1 is a perspective view of the handle of the invention illustrating a base secured to a support surface, such as a dock, the pivotal connection of the handle to the base, and the pin for pivotally, releasably, securing the handle to the base.
Figure 2:
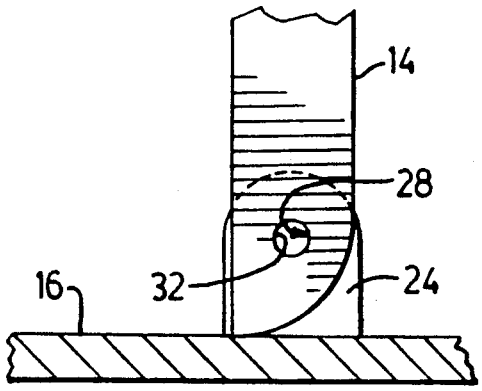
FIG. 2 is a side elevational view of the pivotal connection of the handle to the base taken along lines 2—2 of FIG. 1 and with the handle in the substantially vertical position.

With reference to FIGS. 1 and 2, it can be seen that the invention comprises an elongate handle 10 including at one end thereof a hand-gripping formation 12, connected to an elongate shaft portion 14. Shaft portion 14 is pivotally connected at the end opposite to hand-gripping formation 12 to a base or platform 16 which, in the preferred embodiment, is secured permanently to a suitable support surface 18, such as the upper surface of a dock, launch, or landing and adjacent the edge thereof to which a water vessel, such as a power boat, will be docked.

In particular, base 16 is secured to support surface 18 through the use of suitable securing means, such as high strength screws or bolts 20. Base 16 must be fastened to support surface 18 with sufficient strength to support the weight of an average person, should such person upon gripping hand-gripping formation 12 of handle 10 apply their full weight to the handle when boarding or disembarking from a water vessel, such as a power boat.

Projecting upwardly from base 16 are two opposed spaced apart flange formations 22, 24. Flange formations 22, 24 include therein opposed aligned holes 26, 28, respectively, for reception therein of pin 30 as will hereinafter be explained.

In particular, shaft portion 14 of handle 10 at the opposite end to hand-gripping formation 12 includes therethrough hole 32 of similar dimensions to holes 26, 28 in flange formations 22, 24, respectively, of base 16. In securing handle 10 to base 16 hole 32 of shaft portion 14 is aligned with holes 26, 28 of flange formations 22, 24, respectively, and pin 30 is inserted therethrough to pivotally releasably secure the handle to base 16, and consequently support surface 18, such as a dock, landing or launch.

In this manner the handle of the invention is free to pivot, and particularly from a substantially horizontal position, as illustrated in FIG. 1, to a substantially vertical position, as shown by dotted lines in FIG. 1.

In the preferred embodiment the handle is typically of a rust-proofed metallic construction. A strong plastic, however, can also be used. Shaft portion 14 is preferably 18" long so that when handle 10 is pivotally secured to base 16 and is in the substantially horizontal position hand-gripping formation 12 extends sufficiently beyond the edge of support surface 18, such as a dock, launch, or landing, and preferably at least 5", to enable a user adequate room to grip same. Further, when shaft portion 14 is moved to the substantially vertical position, as illustrated in dotted lines in FIG. 1, it should be of sufficient length to enable a user to grasp hand-gripping formation 12 without having to bend over in an uncomfortable position.

Base 16 can be of wood, strong plastic, or metallic construction and is preferably of dimensions 6"×6" in plan view. It is also preferable that base 16 be sufficiently thin so that it does not upstand from support surface 18, such as a dock, launch, or landing, to present an obstacle which could be a hazard to users of the dock, launch, or landing.

Figure 3:
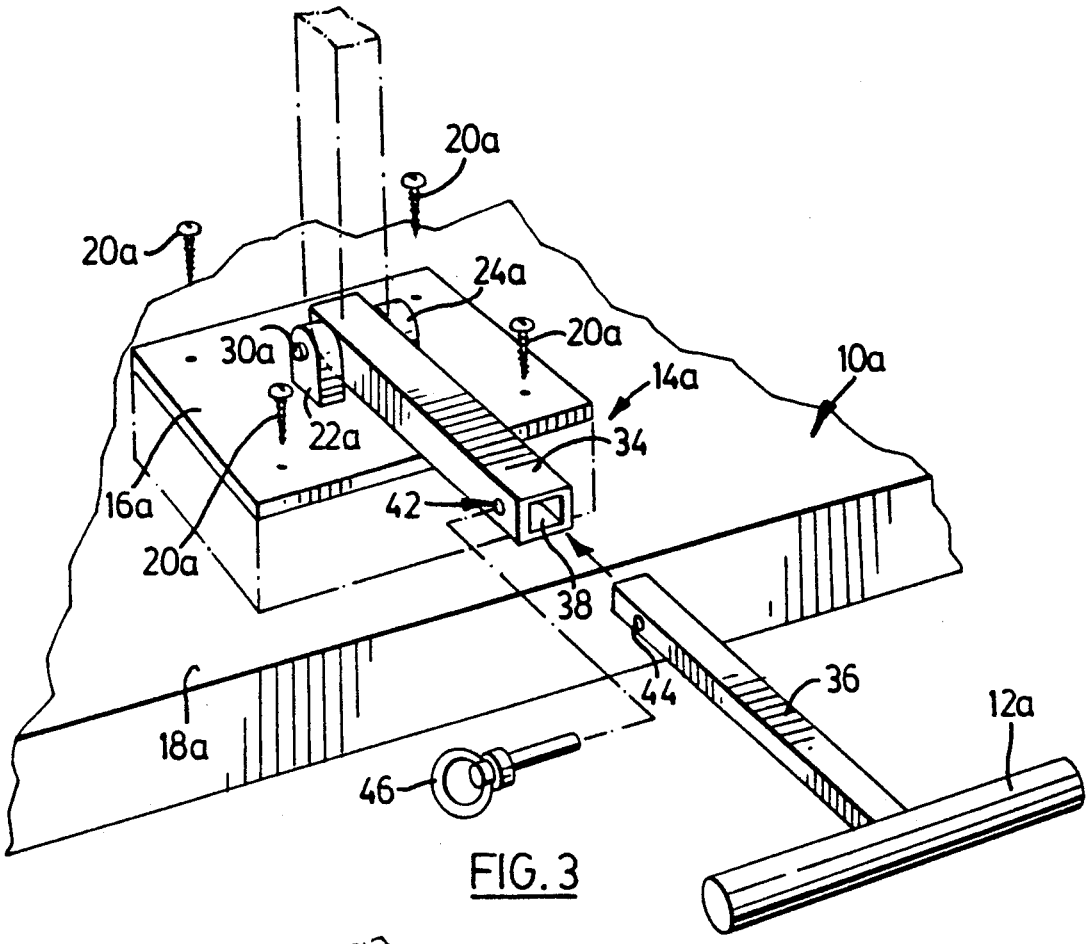
FIG. 3 is a perspective view of a further embodiment of the handle of the invention illustrating an alternative releasable connection of the handle to the base featuring an elongate shaft comprising slidable inner and outer extendable shaft portions, and a pin releasably securing such inner and outer extendable shaft portions against separation or displacement with respect to one another.

FIG. 3 represents a second embodiment of the invention wherein like reference characters refer to similar parts as in the first embodiment of the invention.

In the second embodiment elongate shaft portion 14*a* of handle 10*a* is divided into two slidable outer and inner extendable shaft portions, namely, lower shaft portion 34, and upper shaft portion 36.

Lower shaft portion 34 of shaft portion 14*a* is pivotally secured to base 16*a* through means of pin 30*a* passing through respective holes in flange formations 22*a*, 24*a* of base 16*a* and shaft portion 14*a*, as in the first embodiment. In the second embodiment, however, lower shaft portion 34 of shaft portion 14*a* can be relatively permanently pivotally secured to base 16*a*.

In the second embodiment upper shaft portion 36 of shaft portion 14*a* is releasably secured within lower shaft portion 34 of shaft portion 14*a*.

In particular, upper shaft portion 36 of shaft portion 14*a* is releasably secured within lower shaft portion 34 by sliding or displacing same within channel formation 38 provided within lower shaft portion 34 until holes 42, 44 provided within lower and upper shaft portions 34, 36, respectively, align. Once aligned pin 46 is inserted through holes 42, 44 of lower and upper shaft portions 34, 36, respectively, releasably securing such shaft portions against relative sliding movement or displacement with respect to one another, and particularly against separation.

Other ways to releasably secure upper and lower shaft portions against relative displacement with respect to one another include, for example, providing detents located in lower shaft portion 34 adapted to receive biased clips provided in upper shaft portion 36. To release upper shaft portion 36 from lower shaft portion 34 pivotally secured to base 16*a* the clips are compressed to release the detents and allow upper shaft portion 36 to be removed slidably from lower portion 34.

Figure 4:
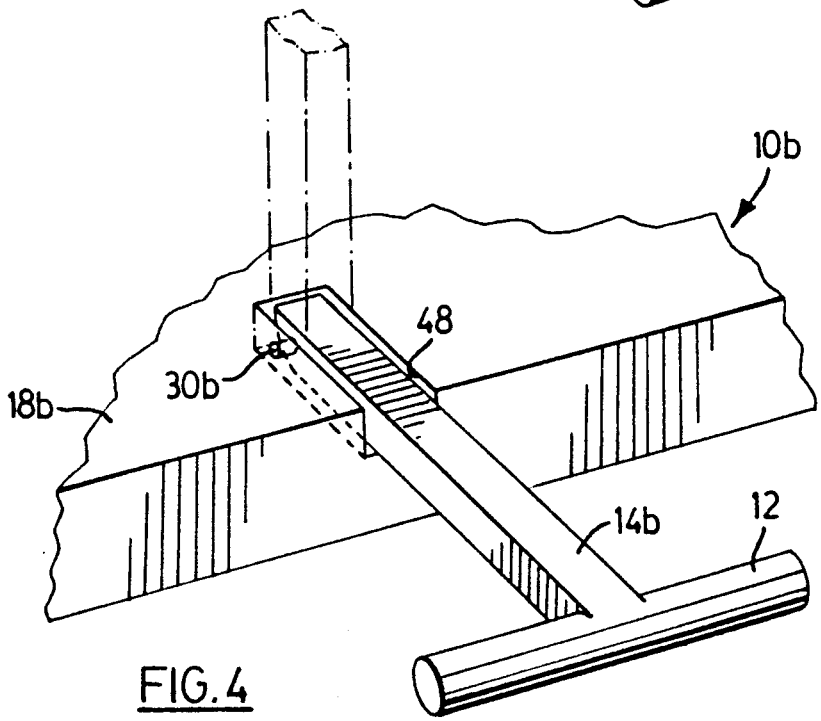
FIG. 4 is a perspective view of yet another embodiment of the invention wherein the handle is sunken within the support surface, such as the deck of a dock, and pivotally secured therewithin.

FIG. 4 illustrates a further embodiment of the invention wherein the base to which the handle is pivotally secured is a recess 48 provided in support surface 18*b*, such as a dock, launch, or landing. This particular embodiment ensures that there is no part of the base or handle projecting above the dock, launch, or landing, posing an obstacle to persons passing by on the dock, launch, or landing, and, consequently, a potential hazard.

In the embodiment illustrated in FIG. 4 shaft portion 14*b*is permanently secured at one end within recess 48 of the support surface. Should it be desired that the handle be removable from the dock, launch, or landing, then inner and outer slidable shaft portions can be provided as detailed for the second embodiment of the invention above, and illustrated in FIG. 3. A pin, as described in the embodiment illustrated in FIGS. 1 and 2, can also be used—provided access to the pin is allowed for in recess 48 to enable the pin to be inserted or removed.

It can be appreciated that upon boarding or disembarking a water vessel, such as a power boat, docked at a suitable surface, such as a dock, launch, or landing, that when the handle is in the substantially horizontal position adequate support for the handle is provided by the base of the handle as well as the support surface so that the handle can be used for leverage by a person boarding or disembarking the water vessel.

In moving the handle to the substantially vertical position it can be appreciated that having the handle locked in the substantially vertical position is desirable so that adequate support can be provided, particularly for a person boarding a water vessel from the support surface.

Figure 7:
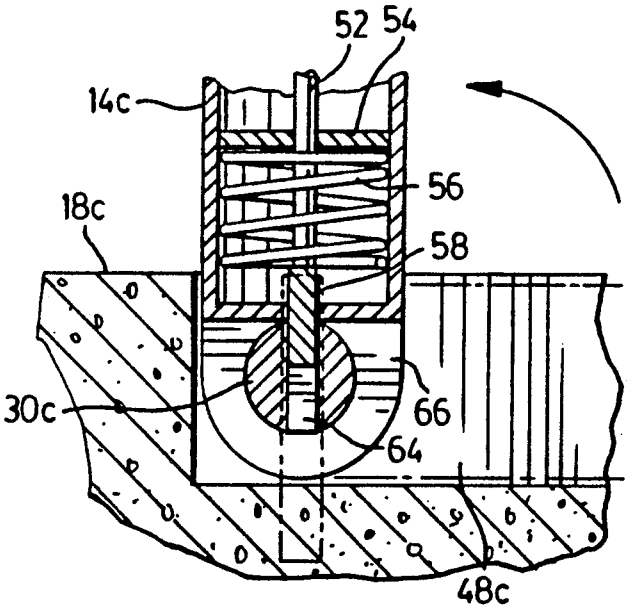
FIG. 7 is a side elevational view taken along lines 7—7 of FIG. 6 and showing the handle locked in the substantially vertical position.
Figure 5:
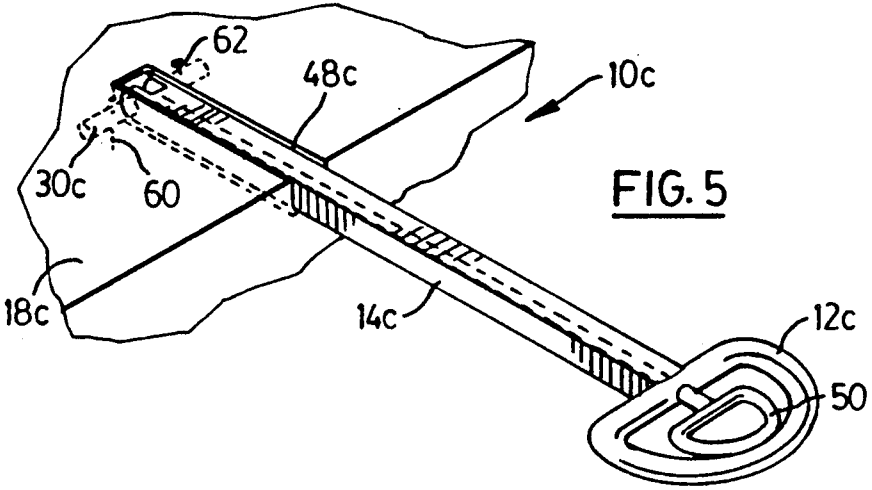
FIG. 5 is a perspective view of another embodiment of the invention wherein the handle includes a mechanism which releasably locks the handle at an angular orientation with respect to the support surface.
Figure 6:
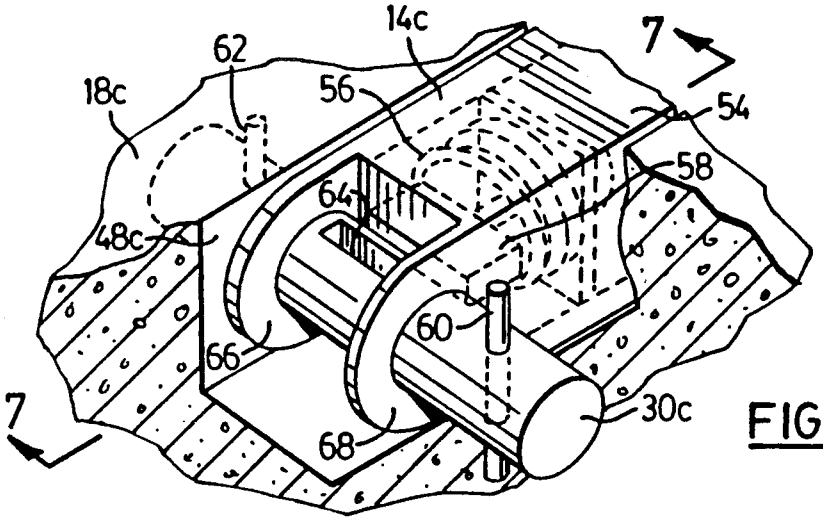
FIG. 6 is a perspective view, partly broken away, illustrating the spring biased plate and slotted pin which operably cooperate to releasably lock the handle in the substantially vertical position.

FIGS. 5 to 7, inclusive, illustrate a means for releasably locking the handle in the substantially vertical position. In particular, hand-gripping formation 12*c* of handle 14*c* is configured, in the preferred embodiment, so that an operable actuating member 50 can be received therein. It is desirable that the actuating member releasably locking the handle in the substantially vertical position be operable so that same can be used by a person boarding or disembarking the water vessel with one hand so that the other hand is free. Consequently, it is desirable that actuating member 50 be configured so as to be operable with the same hand that grips hand-gripping formation 12*c*.

Actuating member 50 has a rod 52 connected thereto and extending through hollow elongate shaft portion 14*c* towards pivot pin 30*c*. This construction is preferable for neatness, but it can be appreciated that rod 52 could also extend along the sides, top, or bottom, of elongate shaft portion 14*c*.

Rod 52 extends through hollow shaft portion 14*c*, spring retention plate 54, and spring 56, and is connected to locking plate 58 at the opposed end to actuating member 50.

Spring 56 biases locking plate 58 away from spring retention plate 54. Consequently, squeezing actuating member 50 when gripping hand-gripping formation 12*c* displaces locking plate 58 via rod 52 against the bias of spring 56 and towards spring retention plate 54. In this manner, and as detailed hereinafter, handle 10*c* is released from the substantially vertical position The locking mechanism includes a modified locking pin or pin 30*c* about which handle 10*c* pivots. Pin 30*c* is preferably secured and anchored in one fixed position through means of locking pins 60 and 62, respectively. It can be appreciated that pin 30*c* is unable to rotate about its longitudinal axis. In this manner a recess 64 provided in pin 30*c* is fixed in a position so that it opens upwardly, and particularly in the direction in which handle 10*c* shall be releasably locked, i.e. a substantially vertical position.

Shaft portion 14*c* terminates at the end opposite to hand-gripping formation 12*c* in flange portions 66, 68, respectively, which are provided with suitable openings which pivotally receives therethrough pin 30*c*. Pin 30*c* is then secured to a base, or, as illustrated in FIG. 6, within recess 48*c* by means of locking pins 60 and 62, respectively, with recess 64 opening upwardly as described above.

Briefly, upon rotating handle 10*c* from a substantially horizontal position as illustrated in FIG. 5 to a substantially vertical position it can be appreciated that locking plate 58 is biased against the circular surface of pin 30*c* by spring 56 in cooperation with retention plate 54. Upon reaching the substantially vertical position, plate 58 substantially overlaps upwardly opening recess 64 within pin 30*c*, and due to the biasing of spring 56, is pushed into recess 64.

When the operator desires that the handle be lowered to a substantially horizontal position actuating member 50 within hand-gripping portion 12*c* is gripped and squeezed, displacing locking plate 58 via rod 52 against the bias of spring 56 and out of upwardly opening recess 64 of pin 30*c*. Once locking plate 58 clears recess 64 of pin 30*c* the handle is free to pivot about pin 30*c*.

In the embodiment described, it is preferable that pin 30*c* be at least 3" in diameter and recess 64 be at least 1½" deep so that adequate support is provided to an operator grasping the handle when same is locked in the substantially vertical position.

It can be appreciated that should one desire handle 10*c* can be designed so that it is releasably locked in various angular orientations about pin 30*c*. In particular, upon enlarging pin 30*c* various recesses similar to recess 64 can be provided at different angles about the circular surface of pin 30*c* providing a series of stepped releasable locking positions for handle 10*c*.

Further, it can be appreciated that while, in FIGS. 5 to 7, handle 10*c* is illustrated sunken into the support surface, such as a dock, launch, or landing, within a recess 48*c* as described above for the embodiment of the invention illustrated in FIG. 4, the locking mechanism as described can also work in an embodiment similar to that illustrated in FIGS. 1 and 2 with the handle pivotally secured to a base or platform secured to the support surface.

Figure 8:
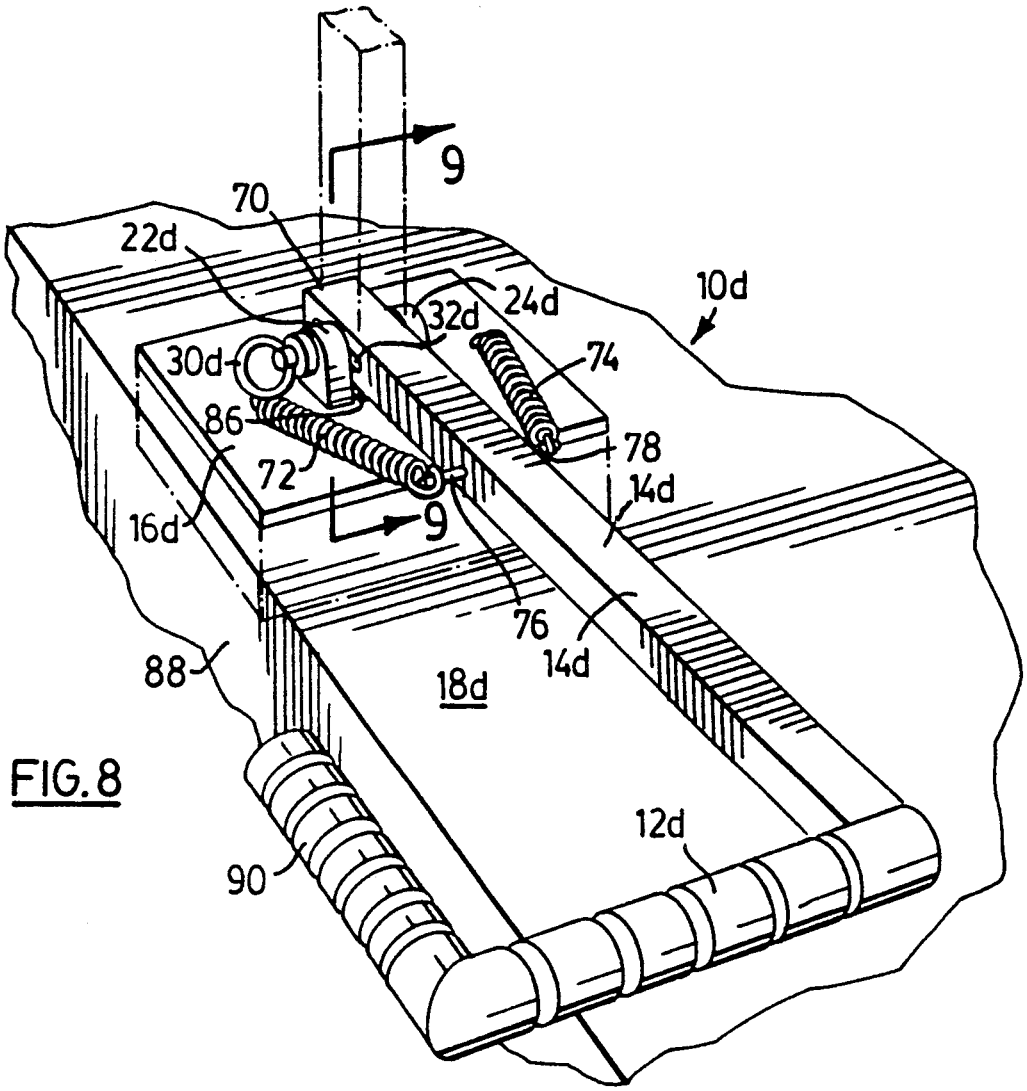
FIG. 8 is a perspective view of yet another embodiment of the invention illustrating a further mechanism which releasably locks the handle in the substantially vertical position in relation to the support surface.
Figure 9:
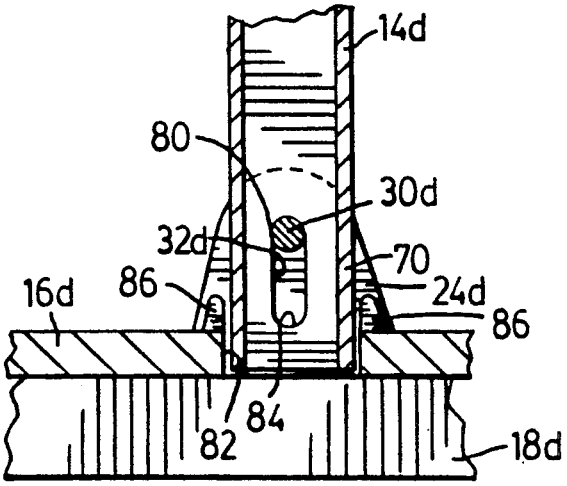
FIG. 9 is a side cross-sectional view of the handle illustrated in FIG. 8 and showing the handle releasably locked in the substantially vertical position.

FIGS. 8 and 9 illustrate a further means for releasably locking a handle in a substantially vertical position. In particular, end 70 of shaft portion 14*d* of handle 10*d* of this embodiment includes therethrough an elongated slot 32*d* of a configuration and size adapted to receive therein in sliding fit pin 30*d* which, as in the embodiment illustrated in FIGS. 1 and 2, is inserted through aligned openings in flange formations 22*d*, 24*d*, respectively, of base 16*d* and into and through aligned elongated slot 32*d* of shaft portion 14*d*.

In this manner, handle 10*d* is able to pivot about pin 30*d* in a similar manner as disclosed above in FIGS. 1 and 2.

Springs 72 and 74, respectively, are secured at one end to either side of handle 14*d* by suitable fasteners as at 76, 78 through conventional means such as screws and or hooks suitably anchored in the opposing sides of handle 14*d*. The other ends of springs 72, 74, respectively, are secured in a similar manner to base 16*d* but disposed slightly outwardly and to the sides of flange formations 22*d*, 24*d*, respectively.

It can be appreciated that the action of springs 72, 74, respectively, is to urge handle 14*d* towards base 16*d*, and, as a consequence, pin 30*d* will normally rest at end 80 of elongated slot 32*d* as best illustrated in FIG. 9.

In order to releasably secure handle 14*d* in the substantially vertical position an opening or aperture 82 is provided within base 16*d* and preferably between flanges 22*d*, 24*d*, respectively, and of a shape and configuration to receive therein end 70 of handle 14*d*, as best illustrated in FIG. 9. Further, it can be appreciated that the extent of elongated slot 32*d* is such that when pin 30*d* approaches, and preferably abuts against end 80 of such slot, as illustrated in FIG. 9, end 70 of handle 14*d* is firmly engaged within opening 82 in base 16*d* and in contact with the upper surface of dock 18*d* or another suitable support surface so that handle 14*d* is securely anchored in the vertical position.

The extent of elongated slot 32*d* is such that pin 30*d* comes in contact with end 84 of such slot only after end 70 of handle 14*d* clears opening 82 in base 16*d* so that the operator can swing the handle from the generally vertical position to a generally horizontal position.

Briefly, then, it can be appreciated that end 70 of handle 14*d* when in the generally vertical position is normally biased into engagement within aperture or opening 82 provided in base 16*d* through the action of springs 72, 74. Handle 14*d* rotates normally from a generally horizontal position to a generally vertical position about and with pin 30*d* abutting end 80 of elongated slot 32*d*, due to the biasing action of springs 72, 74. As handle 14 approaches the vertical position, end 70 of handle 14*d* comes in contact with the edge of base 16*d* , and more particularly in contact with raised lip 86 so that handle 14*d* is displaced upwardly against the bias of springs 72, 74 and approaches the limiting position defined by end 84 of elongated slot 32*d*. Once end 70 of handle 14*d* substantially overlaps opening 82 within base 16*d* such end is forceably displaced into the opening due to the biasing action of springs 72, 74, and with the downward displacement being limited by the depth of opening 82 and the upper surface of dock 18, or the engagement of pin 30*d* abutting against end 80 of slot 32*d*.

When the operator desires the handle to be rotated to a substantially horizontal position the hand-gripping formation 12*d* is grasped, and the handle is pulled upwardly so that pin 30*d* approaches end 84 of elongated slot 32*d* and end 70 of handle 14*d* clears opening 82 of base 16*d*, so that handle 14*d* can be pivoted about pin 30*d* in the usual manner.

Should it be desired or required to strengthen the vertical support imparted to handle 14*d* by having end 70 engaged within opening 82, then reinforcements can be provided, such as appropriate raised lips as at 86 illustrated in FIG. 9. Against these lips the sides of handle 14*d* abut when such handle is in a substantially vertical position. It can be appreciated that when using this type of reinforcement elongated slot 32*d* must be appropriately dimensioned so that end 70 of the handle, when pulled substantially upwardly and rotated about pin 30*d*, clears both opening 82 and raised lips 86 in base 16*d*.

FIG. 8 discloses handle 10*d* arranged at a different orientation to the dock 18*d* than those illustrated in the embodiments of FIGS. 1 through 7, inclusive. This arrangement, however, is not specific to the embodiments of FIGS. 8 and 9, but also can be utilized in previous embodiments disclosed. Further, the locking mechanism disclosed in FIGS. 8 and 9 is not limited to the orientation of the handle as illustrated, but will equally apply with the handle orientated in the same arrangement as that illustrated in FIGS. 1 and 2.

In particular, the orientation disclosed for the handle in FIGS. 8 and 9 features handle 14*d* running parallel to the edge 88 of dock 18*d*. This orientation minimizes the extent that base 16*d* sticks into the dock surface area and which could cause an obstacle to persons utilizing the dock surface. In arranging the handle so that it lies parallel to the edge of the dock, as illustrated in FIG. 8, it can be appreciated that hand-gripping formation 12*d* need not extend transversely to shaft 14*d* in a T-shaped arrangement, as previously illustrated, but can extend in only one direction so that it presents longitudinally extending formation 90 which lies over edge 88 of dock 18*d* when the handle is disposed generally horizontally and is generally parallel to the shaft of handle 14*d*. This provides an operator with more gripping surface, as well as allows the handle to be grasped from two orientations, namely parallel and transverse to the edge 88 of dock 18*d*, facilitating ease of use.

It can be appreciated that although this invention is particularly described and illustrated having regard to boarding or disembarking a water vessel, such as a powerboat, other uses can be found. For example, the handle of this invention is ideally suited in assisting the physically challenged or elderly in rising from a reclined or sitting position to a standing position, and reversely, or for embarking and disembarking a wheelchair.

It is therefore understood that variations or alterations may be undertaken by those persons skilled in the art in respect of the invention described and illustrated herein without departing from spirit and scope of the invention as set forth in the claims appended hereto.

What I claim is:

1. A handle for assisting in boarding or disembarking a water vessel, said handle comprising an elongate shaft portion, a hand-gripping formation located at one end of said shaft portion, a base for displaceably, pivotally, receiving the opposed end of said shaft portion and securing same to a suitable support surface and located near an edge of the support surface so that said hand-gripping formation and said shaft portion swing about said pivot above the support surface to assist a person in boarding or disembarking a water vessel adjacent the edge of the support surface, and a locking means to releasably secure the handle in a substantially vertical position comprising the combination of an opening of a configuration to receive therein the opposed end of said shaft portion and a bias means operably connected to said shaft portion to normally displace said opposed end of said shaft portion within said opening in said base when said handle is swung about said displaceable pivot so that said opposed end of said shaft portion overlies said opening in said base.

2. A handle according to claim 1 wherein a lip is provided around said opening in said base.

3. A handle according to claim 2 wherein said bias means comprises spring means operably connected between said handle and said base to normally urge said handle into engagement within such aperture when same is disposed substantially vertically.

4. A handle according to claim 3 wherein said opposed end of said shaft portion is releasably, displaceably, pivotally secured to said base by a pin passing through respective aligned elongated slots in said opposed end of said shaft portion and into appropriate aligned holes presented by said base.

5. A handle according to claim 4 wherein said base comprises a plate formation secured to the support surface, said plate formation having at least one flange formation upstanding therefrom and presenting said hole adapted to pivotally receive said pin.

6. A handle according to claim 5 wherein said plate formation of said base has two flange formations upstanding therefrom and presenting said aligned holes adapted to pivotally receive said pin.

7. A handle for assisting in boarding or disembarking a water vessel, said handle comprising an elongate shaft portion, a hand-gripping formation located at one end of said shaft portion, and a base for pivotally receiving the opposed end of said shaft portion and securing same to a suitable support surface and located near an edge of the support surface so that said hand-gripping formation and said shaft portion swing about said pivot above the support surface to assist a person in boarding or disembarking a water vessel adjacent the edge of the support surface, said base comprising a lock for releasably locking the handle at an angular orientation with respect to and above the support surface, and said hand-gripping formation comprising an actuating member operably coupled to said lock to effect the releasable locking of said handle at an appropriate angular orientation, said lock comprising a locking pin fixedly secured to said base so as to not rotate about its longitudinal axis, and provided with at least one recess opening upwardly at an angular orientation to the support surface, and a locking plate operably coupled to said actuating member and biased to urge same against the surface of said locking pin and so configured as to fit within said recess provided in said locking pin when the handle is swung about said pivot so that said locking plate overlaps said recess.

8. A handle according to claim 7 wherein said shaft portion is pivotally secured to said base by said locking pin passing through respective aligned holes in said opposed end of said shaft portion.

9. A handle according to claim 8 wherein said bias is a spring located between said locking plate and a retention plate so as to urge said locking plate away from said retention plate and against said surface of said locking pin and into said recess when said handle is swung about said pivot so that said locking plate overlaps said recess.

10. A handle according to claim 9 wherein said actuating member is operably coupled to said lock by a rod extending from said hand-gripping formation to said locking plate.

11. A handle according to claim 10 wherein said rod extends from said hand-gripping formation through openings provided in said retention plate and said spring to said locking plate.

12. A handle according to claim 11 wherein said elongate shaft portion of said handle is hollow and said rod operably coupling said actuating member to said lock extends substantially through said hollow elongate shaft portion.

13. A handle according to claim 12 wherein said hand-gripping formation is substantially D-shaped in configuration and said actuating member is similarly configured and of a lesser extent so as to fit displaceably within said hand-gripping formation.

14. A handle according to claim 13 wherein said base comprises a plate formation secured to the support surface, said plate formation having at least one flange formation upstanding therefrom adapted to pivotally receive said opposed end of said shaft portion.

15. A handle according to claim 14 wherein said opposed end of said shaft portion is releasably pivotally to said upstanding flange formation by said locking pin passing respective aligned holes in said opposed end of said shaft portion and said upstanding flange formation.

16. A handle according to claim 15 wherein said plate formation of said base has two formations upstanding therefrom adapted to pivotally receive said opposed end of said shaft portion.

17. A handle according to claim 13 wherein said base comprises a recess provided within the suitable support surface and opening to an edge thereof, the respective sides of said recess adapted to pivotally receive therein said opposed end of said shaft portion.

18. A handle according to claim 17 wherein said opposed end of said shaft portion is releasably pivotally secured to said respective sides of said recess by said locking pin passing through respective aligned holes in said opposed end of said shaft portion and said respective sides of said recess.

* * * * *